US006161975A

United States Patent [19]

Clarke

[11] Patent Number: 6,161,975

[45] Date of Patent: Dec. 19, 2000

[54] MARKER ASSEMBLY

[75] Inventor: Timothy J. Clarke, Ridgefield, Conn.

[73] Assignee: EK Success, Ltd., Clifton, N.J.

[21] Appl. No.: 09/311,615

[22] Filed: May 13, 1999

[51] Int. Cl.[7] ..... B43K 23/06; B43K 23/12; B43K 27/08; B43K 29/00

[52] U.S. Cl. ..... 401/34; 401/48; 401/131; 401/195; 401/198; 401/202; 446/69; 446/97; 446/101; 446/146; D19/46; D19/47

[58] Field of Search ..... 401/34, 35, 37, 401/48, 131, 198, 199, 202, 195; D19/36, 41–43, 45–47; 446/146, 117, 69, 101, 97

[56] References Cited

U.S. PATENT DOCUMENTS

| | | | |
|---|---|---|---|
| D. 269,444 | 6/1983 | Medebach | D19/42 |
| D. 345,176 | 3/1994 | Monzyk | D19/42 |
| D. 384,103 | 9/1997 | Chuang | D19/36 X |
| 3,481,677 | 12/1969 | Abrahamson | 401/198 |
| 3,993,409 | 11/1976 | Hart | 401/199 |
| 4,306,818 | 12/1981 | Manusch | 401/202 X |
| 4,461,591 | 7/1984 | Mutschler | 401/258 |
| 4,519,788 | 5/1985 | Ajiro et al. | 446/99 X |
| 4,986,685 | 1/1991 | Kiyokane | 446/146 X |
| 5,230,578 | 7/1993 | Fuhrmann, III et al. | 401/202 |
| 5,411,344 | 5/1995 | Gagne | 401/48 X |
| 5,433,545 | 7/1995 | Keil | 401/40 |
| 5,622,441 | 4/1997 | Lambert, Sr. | 401/209 |
| 5,688,062 | 11/1997 | Shih | 401/34 X |

FOREIGN PATENT DOCUMENTS

| | | | |
|---|---|---|---|
| 982772 | 6/1951 | France | 401/34 |
| 21778 | 6/1976 | Japan | 41/199 |

*Primary Examiner*—Henry J. Recla
*Assistant Examiner*—Kathleen J. Prunner
*Attorney, Agent, or Firm*—Sofer & Haroun, LLP

[57] ABSTRACT

A marker assembly which includes a first end cap, a first marker body, and a second end cap, each component having a front portion and a rear portion. The front portion of the first marker body nests within the rear portion of the first end cap. The front portion of the second end cap nests within the rear portion of the first marker body. The formation results in a predetermined interconnected marker configuration.

18 Claims, 6 Drawing Sheets

MARKER ASSEMBLY

FIELD OF THE INVENTION

This invention relates to marking pens, and more particularly, to marking pens that interconnect with one another, with the caps of the first and last marker forming front and rear ends so as to form recognizable objects such as animals, vehicles, or every other inanimate objects.

BACKGROUND OF THE INVENTION

Various types of writing implements have been produced which are designed to apply ink or staining substances to appropriate surfaces such as paper. One such writing implement is commonly known in the art as a "marking pen" or, simply, a "marker." Markers usually have relatively large nibs which, in turn, produce marks of relatively large dimension. Such marks may be desired to create art work, for professional uses, for children's coloring books, among other applications.

To prevent drying of the marker nib when not in use, markers are provided with caps that surround the nib and form an air tight seal. Marker caps also serve to protect the marker nib from damage and to make certain that ink from the marker nib does not inadvertently stain unintended surfaces. Traditionally, when in use, the marker cap is removed from the marker barrel, thereby exposing the nib. The marker cap may then be temporarily stored on the opposite end of the marker barrel as most barrels have accommodations so that the marker cap may be friction fit on the opposite end to prevent loss or misplacement of the marker cap.

Marker caps along with marker barrels are often designed to appeal to children by disposing various designs and decorations on the marker barrel or cap. This is due to the fact that markers are used in great numbers by school-aged children for coloring, design work, and the like. For example, markers have been provided with a cap that represents the head of an animal. The barrel portion of such a maker is configured to represent the body of the animal. It is also known in the art to provide marker barrels having ball-shaped or "chubby" contours allowing the typically small hands of children to grip the marker barrel.

Along with markers, building blocks have long been standard playthings for children. Blocks allow a child to develop skills while providing an outlet for creativity. Some building blocks have means which allow the blocks to securely interconnect to one another. For example, U.S. Pat. No. 4,249,336 to Moe, discloses interstacking blocks capable of intercoupling. In turn, various shapes can be created and such shapes may be easily preserved. There is a need for a device that combines the benefits of markers and blocks.

A variety of marking pens and caps are disclosed in the prior art. For instance, U.S. Pat. No. 3,481,677 to Abrahamson discloses a marking device having a tubular barrel. An opening in at least one end of the barrel contains a wick or nib. This invention does not disclose a cap for the nib of the pen. Furthermore, there is no means by which a series of marking devices may be interconnected to form a chain.

U.S. Pat. No. 5,230,578 to Fuhrmann discloses a cap for a pen having a tubular member with a closed wall at one end and an opening at the other end. The cap includes apertures which are configured to allow air to communicate with the interior of the cap to dry residual ink on the writing point of the implement. This invention does not disclose a means by which a series of pens may be interconnected to form a chain.

U.S. Pat. No. 3,993,409 to Hart discloses a coloring pen having a tubular barrel with a porous nib disposed at one end and an open end. The coloring pen includes a cap that covers the porous nib and is capable of securely fitting within the open end of the tubular barrel. Thus, multiple pens may be secured in axial alignment. This invention lacks ornamental end caps. Specifically, the invention lacks an ornamental end cap that includes a marker. Furthermore, this invention does not disclose a means that allows a series of markers to be supported in a horizontal position in relation to a support surface, such that the series of markers are displaced from the surface.

While the aforementioned devices provide a variety of marking pen configurations, none combines the benefits of markers and blocks. Accordingly, an assembly is demanded whereby markers securely connect to one another forming recognizable shapes.

OBJECTS AND SUMMARY OF THE INVENTION

It is thus a general object of the present invention to provide a marking pen assembly.

A more specific object of the present invention is to provide a marking pen assembly having interconnectable sub-units capable of forming recognizable shapes.

In accordance with one embodiment of the invention, an assembly is provided including individual markers, each marker having a marker nib cap on one end and a marker nib cap receptacle on the other end. A marker nib cap frictionally fits into the marker nib cap receptacle of another marker. By combining a number of individual markers, a chain is formed. In addition to individual markers, first and second end caps with ornamental covers are provided. The first end cap is capable of receiving the forward end of the chain of markers. The second end cap has a marker nib and marker nib cap. Thus, the rearward end of the chain of markers is capable of receiving the marker nib cap of the second end cap. The first and second end caps combine with the chain of markers to form a recognizable shape.

The above description sets forth rather broadly the more important features of the present invention in order that the detailed description thereof that follows may be understood, and in order that the present contributions to the art may be better appreciated.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings in which:

DETAILED DESCRIPTION OF THE INVENTION

Figure 1:
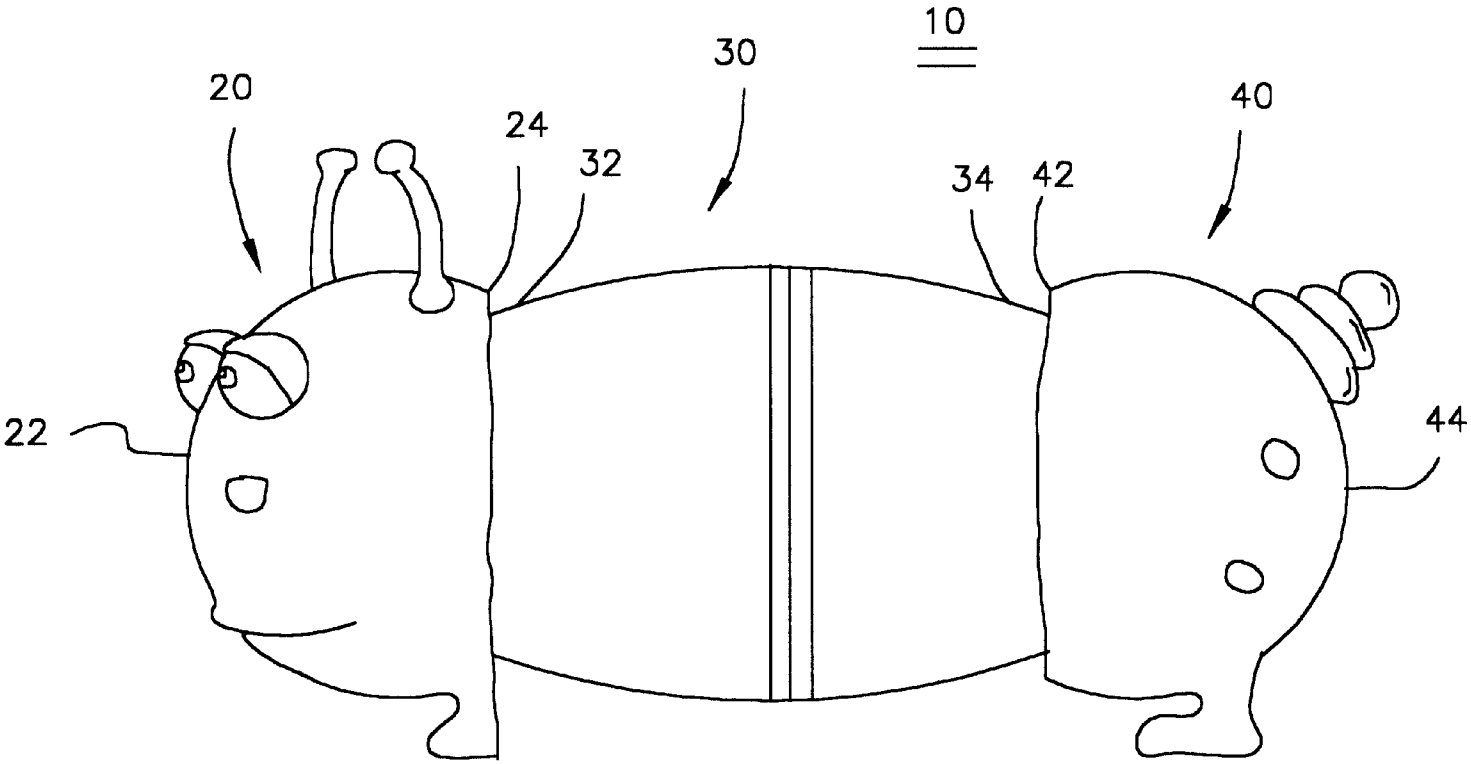
FIG. 1 is a side view of a marker assembly.
Figure 2:
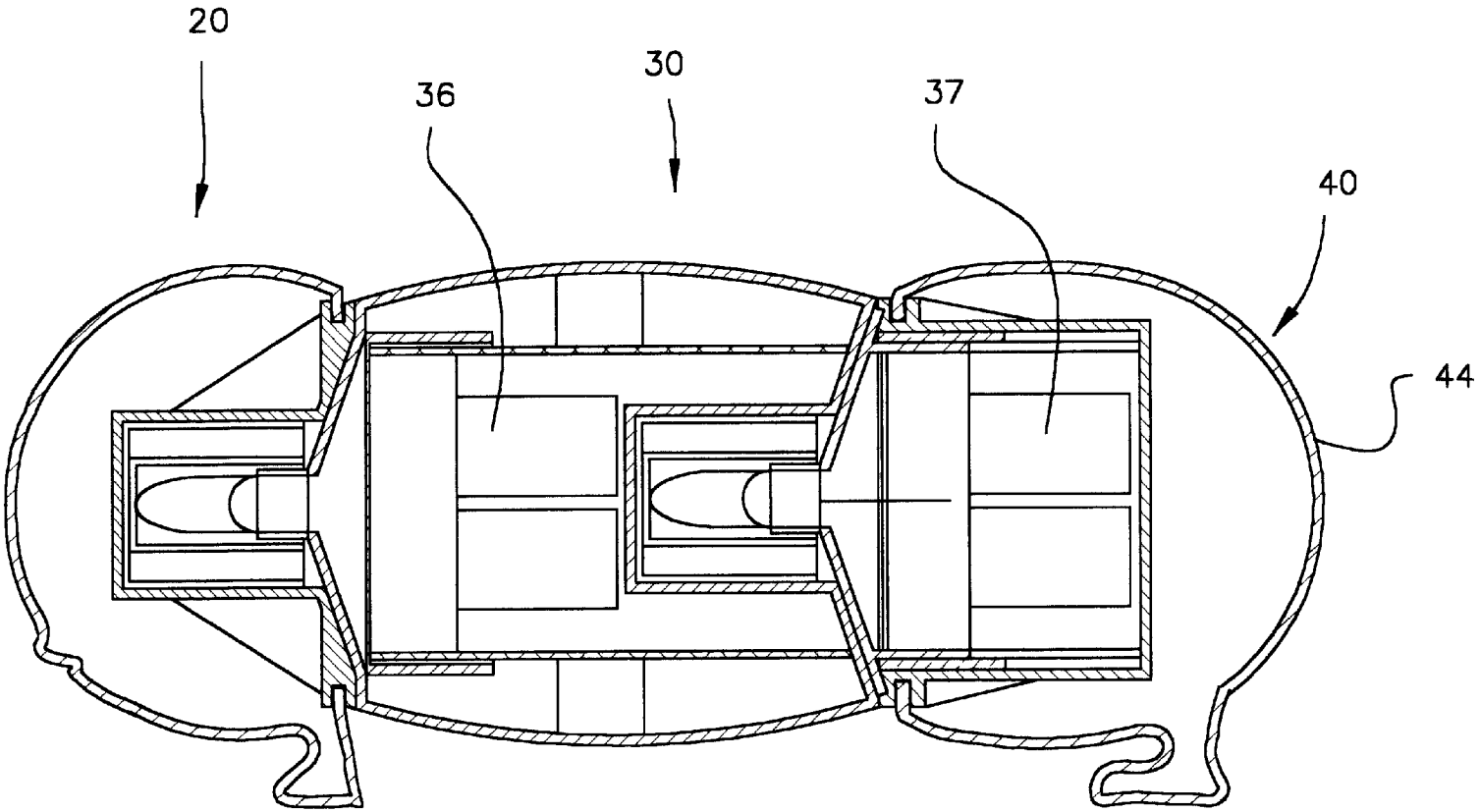
FIG. 2 is a sectional view of the marker assembly shown in FIG. 1.

With initial reference to FIGS. 1 and 2, a side view of a marker assembly 10 is shown. The marker assembly 10 includes a first end cap 20 which has front 22 and rear 24 portions, a first marker body 30 which has front 32 and rear 34 portions, and a second end cap 40 which has front 42 and rear 44 portions. The front portion 32 of first marker body 30 nests within the rear portion 24 of the first end cap 20. The front portion 42 of the second end cap 40 is capable of nesting within the rear portion 34 of the first marker body 30 so as to form a predetermined interconnected marker configuration generally shown as marker assembly 10.

Figure 3A:
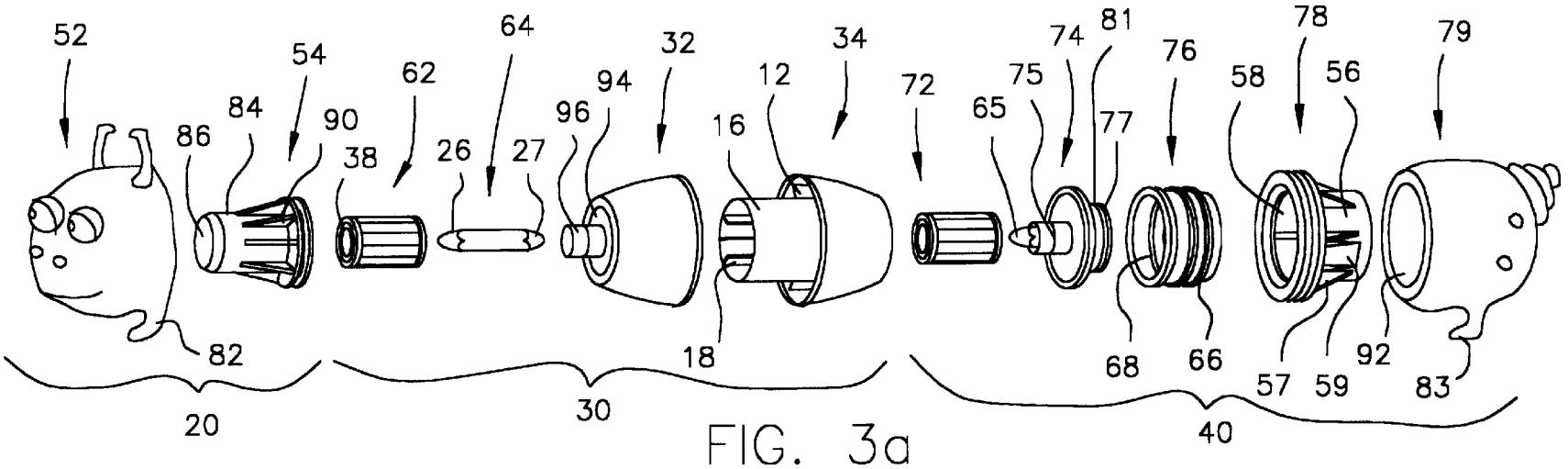
FIG. 3*a* is a front exploded view of the marker assembly shown in FIG. 1.
Figure 3B:
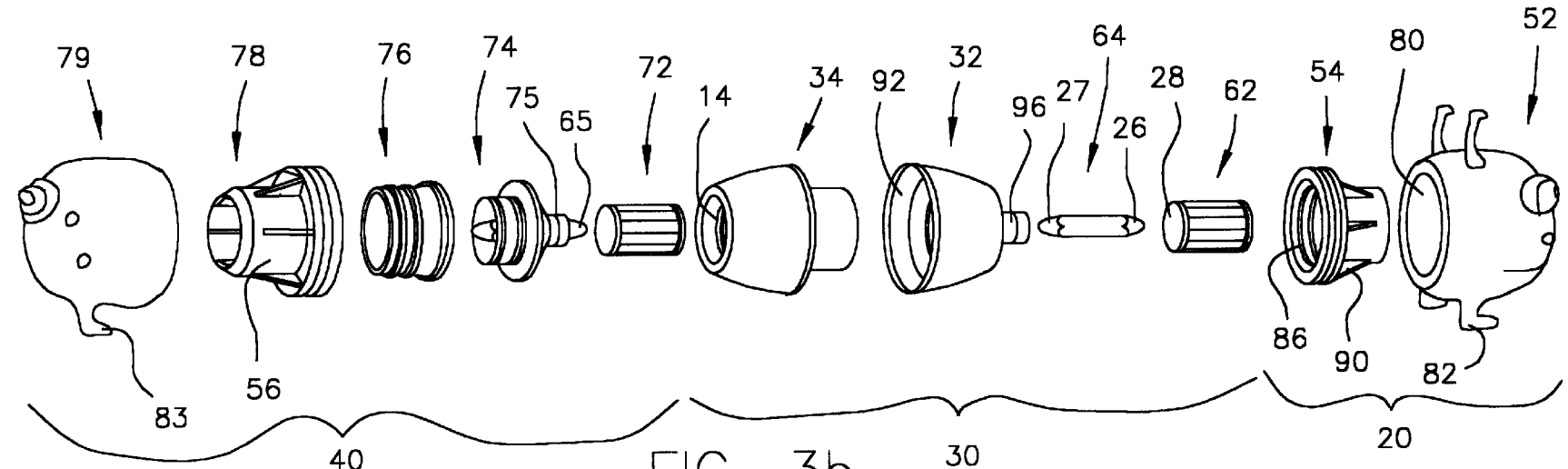
FIG. 3*b* is a rear exploded view of the marker assembly shown in FIG. 1.

Now referring to FIGS. 3*a* and 3*b*, first end cap 20 is shown to be provided with an ornamental front end 52 which is fixedly secured to a molded base 54. Together ornamental front end 52 and the molded base 54 form the first end cap 20 discussed previously.

Ornamental front end 52 is shaped to represent the front portion of a recognizable item. For example, animals such as caterpillars, dogs, and hippos may be represented along with inanimate objects such as trucks, trains, and skyscrapers. Ornamental front end 52 has a circular opening 80 used to assemble first end cap 20. In one embodiment, ornamental front end 52 is provided with one or more front support means 82 which support end 52 on a surface while keeping marker assembly 10 elevated off the surface.

Molded base 54 comprises a tubular member 84 having an opening 86 at a first end, a longitudinally circular passageway through which nib cap 62 (discussed below) may pass, and an end wall 88 at the second end. In the preferred embodiment, ribs 90 protrude perpendicularly from the surface of tubular member 84. Ribs 90, along with tubular member 84, pass through circular opening 80 of ornamental front end 52 such that molded base 54 and ornamental front end 52 are fixedly secured forming first end cap 20 shown in FIGS. 4*a* and 4*b*.

With reference to FIGS. 3*a* and 3*b*, first marker body 30, as discussed previously, generally comprises front 32 and rear 34 portions which are matingly engaged, a nib 64 which is secured to the front portion 32, and a removable nib cap 62 which seals nib 64 from the atmosphere.

Front portion 32 is a bowl shaped member having an opening 92 at a first end, a longitudinally circular passageway wherein an ink fiber reservoir 36 is disposed (see FIG. 2), and an end wall 94 at the second end. A nib holder 96, which is tubular in shape, projects from end wall 94 providing a shaft to the interior of front marker portion 32 and ink fiber reservoir 36.

Rear portion 34 is a bowl shaped member having a front opening 12 at a first end which corresponds to and matingly engages opening 92 of front portion 32, a longitudinally circular passageway, and a rear opening 14 at the second end. A tubular shaped cap receptacle 16 is disposed within the interior of rear portion 34 extending from rear opening 14. Preferably ridges 18 are disposed longitudinally within the interior of cap receptacle 16.

Marker nib 64 generally has a rectangular prism shaped dimensionally stable shaft. Nib 64 is preferably flexible such that it may be bent under writing pressure but returns to its original shape after use. Marker nib 64 is fabricated from a porous, absorbent material, such as felt, synthetic nylon, vinyl fibers, or other appropriate material and is provided with tapered ends which form points 26 and 27. However, nib 64 may take on a variety of other shapes. The diameter of nib 64 is sized so that it may frictionally fit within nib holder 96 of front portion 32. Nib 64 is inserted into nib holder 96 placing point 27 in contact with the ink impregnated fiber pad (not shown) in ink reservoir 36 and having point 26 protrude from holder 96. Ink passes by capillary action down the shaft of nib 64 to point 26, allowing a user to apply ink to appropriate surfaces with first marker body 30.

Marker nib cap 62 is generally tubular in shape and is provided with an opening 28 at a first end, a longitudinally circular passageway through which nib 64 and nib holder 96 may pass, and an end wall 38 provided at the second end. Marker nib cap 62 frictionally engages nib holder 96 completing the assembly of first marker body 30 which is shown in FIGS. 4*a* and 4*b*.

Figure 4A:
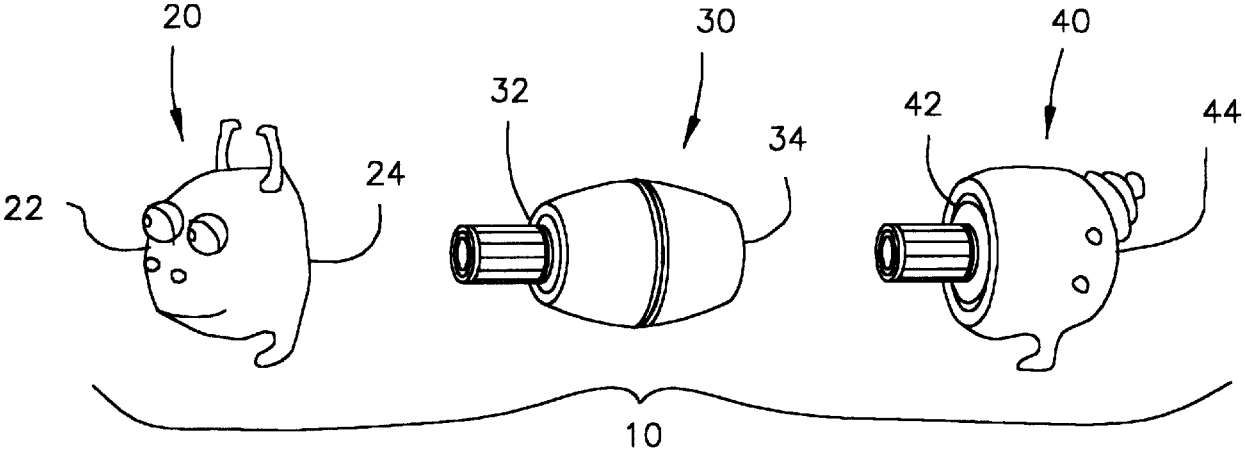
FIG. 4*a* is a front perspective view of the marker assembly shown in FIG. 1, in its unconnected form.
Figure 4B:
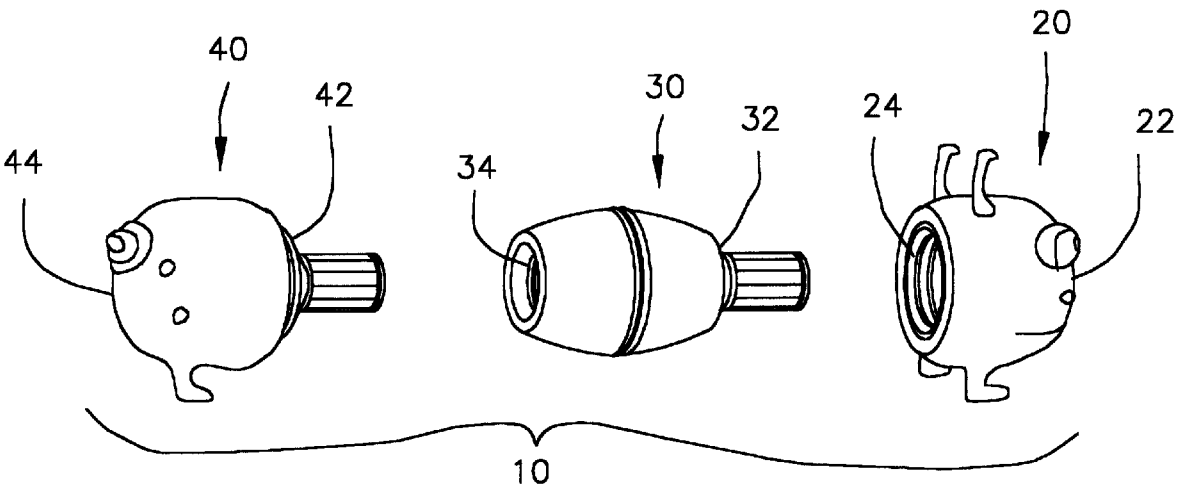
FIG. 4*b* is a rear perspective view of the marker assembly shown in FIG. 1, in its unconnected form.

Considering FIGS. 4*a* and 4*b* along with FIGS. 1 and 2, it can now be understood how the front portion 32 of first marker body 30 nests within the rear portion 24 of the first end cap 20. Nib cap 62 of marker body 30 is inserted through opening 86 into tubular member 84 of molded base 54. Nib cap 62 frictionally fits within tubular member 84 allowing the first marker body 30 to remain in combination with first end cap 20. The force required to remove nib cap 62 from nib holder 96 is greater than the force required to remove nib cap 62 from tubular member 84. Thus, first marker body 30 generally retains nib cap 62 when first marker body 30 is disengaged from first end cap 20.

With reference to FIGS. 3*a* and 3*b*, second end cap 40 is shown to be provided with an ornamental rear end 79 which is fixedly secured to a molded base 78, an insert 76 which is fixedly secured to molded base 78, and an end wall 74 which is fixedly secured to insert 76. Also provided is a nib 65 which is secured to the end wall 74, and a nib cap 72 which seals nib 65 from the atmosphere. Together the aforementioned components form the second end cap 40 discussed previously.

Ornamental rear end 79 is shaped to represent the rear portion of a recognizable item. For example, animals such as caterpillars, dogs, hippos, centipedes, whales, cats, snakes, alligators and pigs may be represented along with inanimate objects such as trucks, trains, skyscrapers, cars, cement mixers, airplanes, robots and snowmen. Ornamental rear end 79 has a circular opening 92 used to assemble second end cap 40. In one embodiment, ornamental rear end 79 is provided with one or more rear support means 83 which support ornamental rear end 79 on a surface while keeping marker assembly 10 elevated off the surface.

Molded base 78 comprises a tubular member 56 having an opening 58 at a first end, and a longitudinally circular passageway through which insert 76 may pass. In the preferred embodiment, ribs 57 protrude perpendicularly from the surface of tubular member 56. Ribs 57, along with tubular member 56, pass through circular opening 92 to provide a secure engagement between molded base 78 and ornamental rear end 79. In one embodiment, molded base 78 is provided with one or more clips 59 that allow insert 76 to be secured to base 78.

Insert 76 is generally tubular in shape. Disposed within the interior of insert 76 is an ink fiber reservoir (shown in FIG. 2). In one embodiment, a ridge 66 is disposed along the outside circumference of insert 76. Upon introduction of insert 76 into the longitudinally circular passageway of molded base 78, clips 59 on molded base 78 retain ridge 66, fixedly securing insert 76 to molded base 78. In one embodiment, a channel 68 is disposed along the inside circumference of insert 76 that allows end wall 74 to be secured to insert 76.

End wall 74 is a disk shaped member having a first and second surface. A tubular shaped nib holder 75 is disposed upon the first surface providing a shaft communicating with the second surface. A cylindrical band 77 is disposed on the second surface of end wall 74 around which a ridge 81 is disposed. Ridge 81 corresponds to and matingly engages channel 68 on insert 76 so that end wall 74 is secured to insert 76.

Nib 65 is provided which is identical to nib 64. Nib 65 is shown in FIGS. 3*a* and 3*b* to be frictionally fit in holder 75. Ink from reservoir 37 travels down the shaft of nib 65 to allow the second end cap to be used for drawing purposes. Nib cap 72 is provided which is identical to nib cap 62. Nib cap 72 frictionally engages holder 75 providing an air tight seal for nib 65. The resulting configuration is second end cap 40 as shown in FIGS. 4*a* and 4*b*.

Considering FIGS. 4*a* and 4*b*, along with FIGS. 1 and 2, it can now be understood how the front portion 42 of second end cap 40 nests within the rear portion 34 of marker body 30. After marker body 30 has been connected to first end cap 20 as described above, nib cap 72 of completed second end cap 40 is inserted through opening 14 into cap receptacle 16 of marker body 30. With the aid of ridges 18, nib cap 72 frictionally fits within cap receptacle 16 allowing first marker body 30 to remain in combination with the second end cap 20. The force required to remove nib cap 72 from nib holder 75 is greater than the force required to remove nib cap 72 from receptacle 16. Thus, second end cap 40 generally retains nib cap 72 when second end cap 40 is disengaged from marker body 30.

The final product of first end cap 20, marker body 30, and second end cap 40 as shown in FIG. 1, now represents an item having a front end, a body, and a rear end. Marker assembly 10 comprises two markers. In one embodiment, the two markers have different colored ink. Ink color may be indicated by the color of plastic used to fabricate first marker body 30 or the color of caps 62 and 72. To use the markers, first end cap 52 is removed from marker body 30. Next, rear end cap 40 is removed from marker body 30. By removing marker nib caps 62 and 72, nibs 64 and 65 can be used to apply ink to a suitable surface.

Figure 5:
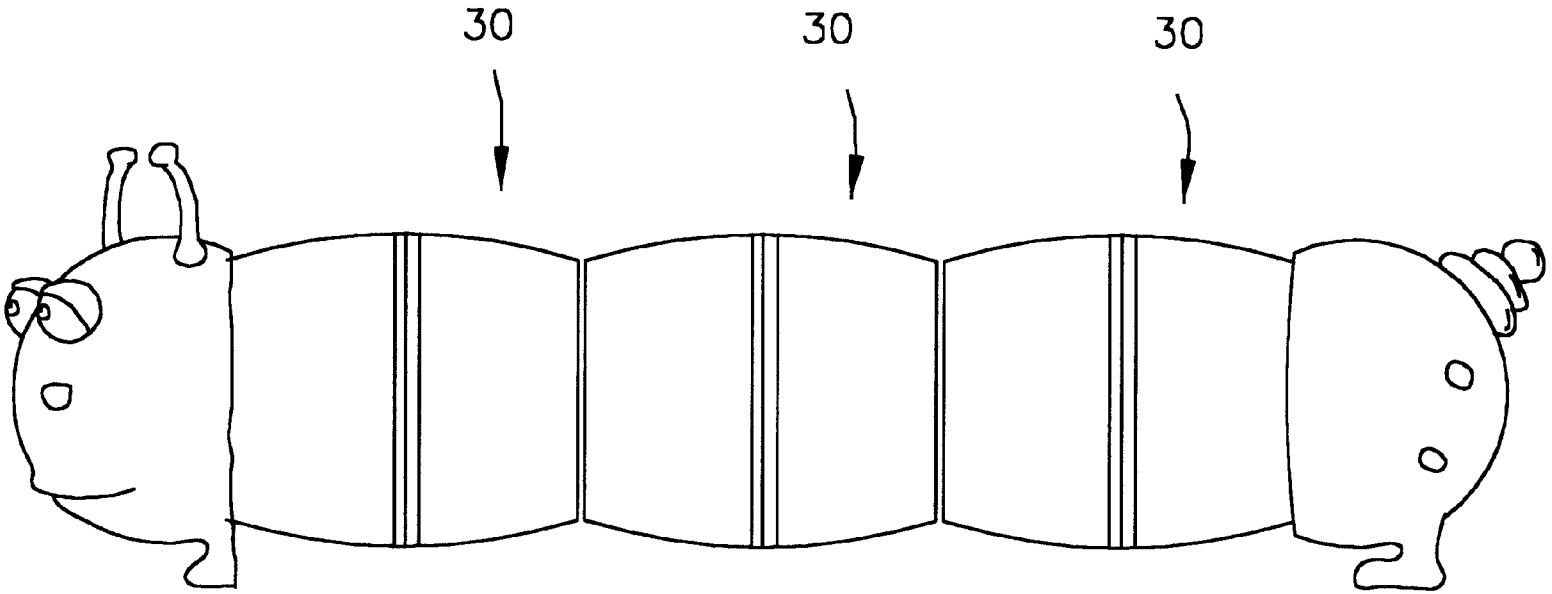
FIG. 5 is a side view of a marker assembly with multiple marker portions.
Figure 6:
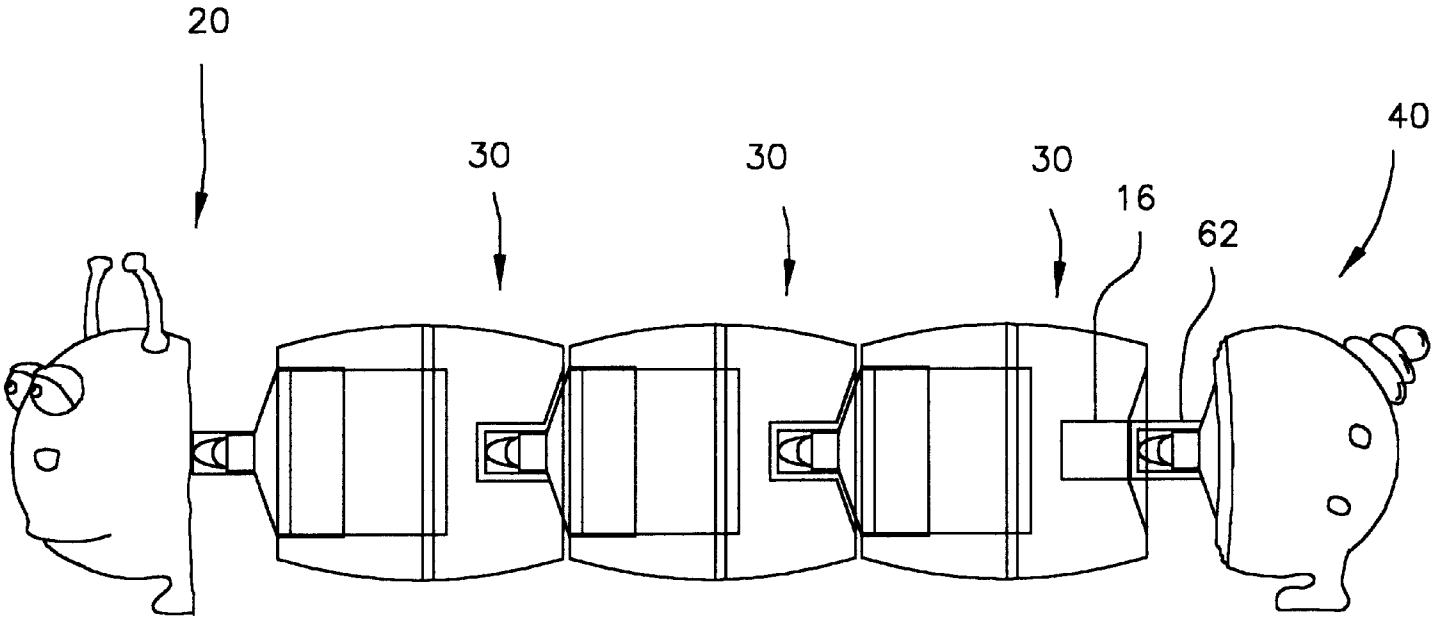
FIG. 6 is a schematic view of the marker assembly shown in FIG. 5.

Referring now to FIGS. 5 and 6, in another embodiment, multiple individual markers 30 may be combined with one another to form a chain. Specifically referring to FIG. 6, it can be seen that each individual marker 30 interconnects with another marker 30 via friction fit between caps 62 and marker cap receptacles 16. The chain of markers 30 can be any length such as three, four, five, six, or even seven markers, but is here shown to include three individual markers 30. Once again, markers 30 within the chain may, contain varied ink colors. Assorted first 20 and second 40 end caps may be provided such that they will represent a recognizable shape when used in combination. However, non-matching caps 20 and 40 may be combined if a user so desires.

Completed marker assembly 10 may be provided as part of an overall design scheme. In such a scheme individual marker bodies 30 are fashioned in such a way to match first 20 and second 40 end caps. For example, if end caps 20 and 40 represent the front and rear of a dog, respectively, marker bodies 30 may represent the body of a dog in shape, coloration, and texture. Furthermore, the color of the ink used in individual marker bodies 30 may include tones that are evocative of a dog's colorations. Thus, the markers can be employed to draw a representation of a dog.

Completed marker assembly 10 has the capability of resting on a flat surface supported by front and rear support means 82 and 83. As depicted in FIG. 1, front and rear support means 82 and 83 represent the feet of an animal. However, in other embodiments, support means 82 and 83 may represent wheels among other appropriate objects. In the preferred embodiment, support means 82 and 83 are integral to respective end caps 20 and 40.

Thus, while there have been shown and described and pointed out fundamental novel features of the invention as applied to alternative embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto. It is to be understood that the drawings are not necessarily drawn to scale, but that they are merely conceptual in nature.

What is claimed is:

1. A marker assembly having at least three components, said assembly comprising:

a first end cap comprised of a hollow front portion and a molded rear portion defining a cavity, said front portion having a face portion;

a first marker body having a front portion and a rear portion, a first nib disposed on said front portion of said first marker body and a removable first nib cap covering said first nib, said first nib cap nesting within said cavity of said rear portion of said first end cap; and a second end cap comprised of a molded front portion defining a cavity and a hollow rear portion, said rear portion having a tail portion, a second nib disposed within said cavity of said front portion of said second end cap and a removable second nib cap covering said second nib, said second nib cap nesting within said rear portion of said first marker body so as to form a predetermined interconnected marker configuration with said first marker body, said face portion, and said tail portion representing an item selected from a group consisting of a caterpillar, a centipede, a hippo, a whale, a dog, a cat, a snake, an alligator, a pig, a car, a truck, a train, a boat, a cement mixer, an airplane, a robot, a snowman, and a skyscraper.

2. A marker assembly as recited in claim 1, said first end cap and said second end cap further comprising feet for horizontally supporting said marker assembly on a support surface so that said marker body is displaced from said support surface.

3. A marker assembly as recited in claim 1, further comprising a second marker body having a front portion and a rear portion, a nib cap disposed on said front portion, said nib cap of said second marker body nesting within said rear portion of said first marker body, said nib cap of said second end cap nesting within said rear portion of said second marker body so as to form a predetermined interconnected marker configuration with said first end cap, said marker bodies, and said second end cap.

4. A marker assembly as recited in claim 3, further comprising a third marker body having a front portion and a rear portion, nib cap disposed on said front portion, said nib cap of said third marker body nesting within said rear portion of said second marker body, said nib cap of said second end cap nesting within said rear portion of said third marker body so as to form a predetermined interconnected marker configuration with said first end cap, said marker bodies, and said second end cap.

5. A marker assembly as recited in claim 1, said front portion of said first marker body having a means for marking and further comprising a sealed receptacle capable of containing ink, said rear portion of said first marker body hollowed so as to receive said nib cap of said second end cap.

6. A marker assembly as recited in claim 1, said first end cap, said first marker body, and said second end cap fabricated from a plastic material.

7. A novelty writing instrument which provides at least two distinct writing implements, said instrument shaped to simulate the appearance of an animal, the novelty writing instrument having at least three components, said instrument comprising:

a first end cap comprised of a hollow front portion and a molded rear portion, said front portion having a face portion of the animal, said rear portion having a first nesting area for receiving a first nib cap;

a first marker body which comprises the first writing implement, said first marker body having a front portion and a rear portion having a second nesting area, wherein a first nib is disposed on said front portion of said first marker body and the first nib cap removably covers said first nib, said first nib cap nesting within said first nesting area of said rear portion of said first end cap; and a second end cap which comprises the second writing implement, said second end cap comprised of a molded front portion defining a third nesting area and a hollow rear portion, said rear portion having a tail portion which represents the tail portion of the animal, a second nib disposed on said front portion of said second end cap and a removable second nib cap covering said second nib, said second nib cap nesting within said second nesting area of said rear portion of said first marker body so as to form a predetermined interconnected animal, wherein the first end cap represents the head of the animal, the first marker body represents the body of the animal and the second end cap represents the tail end of the animal.

8. The novelty writing instrument of claim 7 wherein said face portion, and said tail portion represent an item selected from a group consisting of a caterpillar, a centipede, a hippo, a whale, a dog, a cat, a snake, an alligator, and a pig.

9. The novelty writing instrument of claim 7, further comprising a second marker body, interposed between said first marker body and said second end cap.

10. The novelty writing instrument of claim 9, further comprising a third marker body, interposed between said second marker body and said second end cap.

11. The novelty writing instrument of claim 7, wherein said first end cap and said second end cap further comprises feet for horizontally supporting said novelty writing instrument on a support surface so that said marker body is displaced from said support surface.

12. The novelty writing instrument of claim 7, wherein said writing instrument is generally linear shaped, said first end cap and said second end cap are generally spherical shaped and mateably connected to said spherically shaped first marker body.

13. A novelty writing instrument which is shaped to simulate the appearance of a vehicle, the novelty writing instrument having at least four components, said instrument comprising:

a first end cap comprised of a hollow front portion and a molded rear portion, said front portion having a face portion of the vehicle, said rear portion having a first nesting area for receiving a first nib cap;

a first marker body having a front portion and a rear portion having a second nesting area, wherein a first nib is disposed on said front portion of said first marker body and the first nib cap removably covers said first nib,said first nib cap nesting within said first nesting area of said rear portion of said first end cap;

a second marker body having a front portion, a second nib and a rear portion having a third nesting area, wherein the second nib is disposed on said front portion of said second marker body and a removable second nib cap covers said second nib, said second nib cap nesting within said second nesting area of said first marking body; and a second end cap comprised of a molded front portion having a fourth nesting area and a hallow rear portion, said rear portion having a tail portion which represents the tail portion of the vehicle, a third nib disposed on said front portion of said second end cap and a removable third nib cap covering said third nib, said third nib cap nesting within said third nesting area of said rear portion of said second marker body so as to form a predetermined interconnected vehicle, wherein the first end cap represents the head of the vehicle, the first and second marker bodies represent the body of the vehicle and the second end cap represents the tail end of the vehicle.

14. The novelty writing instrument of claim 13 wherein said face portion, and said tail portion represent an item selected from a group consisting of a car, a truck, a train, a boat, a cement mixer, and an airplane.

15. The novelty writing instrument of claim 14, further comprising a third marker body, interposed between said second marker body and said second end cap.

16. The novelty writing instrument of claim 13, wherein said first end cap and said second end cap further comprises feet for horizontally supporting said novelty writing instrument on a support surface so that said marker body is displaced from said support surface.

17. The novelty writing instrument of claim 13, wherein said writing instrument is generally linear shaped, said first end cap and said second end cap are generally spherical shaped and matingly connected to said spherically shaped first marker body.

18. A novelty writing instrument which provides at least two distinct writing implements, said instrument shaped to simulate the appearance of an animal, the novelty writing instrument having at least three components, said instrument comprising:

a first end cap comprised of a hollow front portion and a molded rear portion, said front portion having a rear portion of the animal, said rear portion of said first end cap having a first nesting area for receiving a first nib cap;

a first marker body which comprises the first writing implement, said first marker body having a front portion and a rear portion having a second nesting area, wherein a first nib is disposed on said front portion of said first marker body and a removable first nib cap covering said first nib, said first nib cap nesting within said first nesting area of said rear portion of said first end cap; and a second end cap which comprises the second writing implement, said second end cap comprised of a molded front portion defining a third nesting area and a hollow rear portion, said rear portion having a tail portion which represents the front portion of the animal, a second nib disposed on said front portion of said second end cap, and a removable second nib cap covering said second nib, said second nib cap nesting within said second nesting area of said rear portion of said first marker body so as to form a predetermined interconnected animal, wherein the first end cap represents the tail of the animal, the first marker body represents the body of the animal and the second end cap represents the head of the animal.

* * * * *